US005305700A

United States Patent [19]

Strong et al.

[11] Patent Number: 5,305,700

[45] Date of Patent: Apr. 26, 1994

[54] TRACK AND SLIDE ASSEMBLY FOR SAILBOATS

[75] Inventors: Jeffrey W. Strong, Boca Raton; John R. Newton, Jupiter, both of Fla.

[73] Assignee: Tides Marine, Inc., Boca Raton, Fla.

[21] Appl. No.: 51,860

[22] Filed: Apr. 26, 1993

[51] Int. Cl.[5] ..... B63H 9/08

[52] U.S. Cl. ..... 114/112; 114/204

[58] Field of Search ..... 114/112, 204, 90, 91; 16/93 R, 93 D, 96 R, 96 D, 96 L, 95 R, 95 W, 95 D, 87 R, 87.2, 87.4 R, 87.4 W, 87.6 R, 87.6 W

[56] References Cited

U.S. PATENT DOCUMENTS

| | | | |
|---|---|---|---|
| 3,248,749 | 5/1966 | Williams | 16/93 D |
| 3,626,429 | 12/1971 | Toder | 16/93 D |
| 4,823,720 | 4/1989 | Foster | 114/108 |
| 4,909,170 | 3/1990 | Smart | 114/90 |

FOREIGN PATENT DOCUMENTS

| | | | |
|---|---|---|---|
| 0256360 | 8/1926 | United Kingdom | 114/112 |

*Primary Examiner*—Sherman Basinger
*Attorney, Agent, or Firm*—Michael Ebert

[57] ABSTRACT

A track and slide assembly for a sailboat having a mast and a boom, the track being attached to the mast and the slides which ride along the track being each coupled to the luff of a sail. Hence, when the sail is raised on the mast, the slides ride up the track, and when lowered, the slides then ride down the track. Formed in the track along its full length is a slot which extends below the outer face of the track and has a cruciform cross section defining a major channel and a minor channel that intersects the major channel at a point below the face of the track and is at right angles to the major channel. Each slide includes a cylindrical post that is slidable in the major channel of the track and a disc-shaped runner that intersects the post and is integral therewith, the runner being slidable in the minor channel whereby the slide is rotatable within the slot as well as being slidable therein and therefore does not bind to the track when a torque force is applied to the slide by the sail to which it is coupled.

11 Claims, 2 Drawing Sheets

Fig. 1.
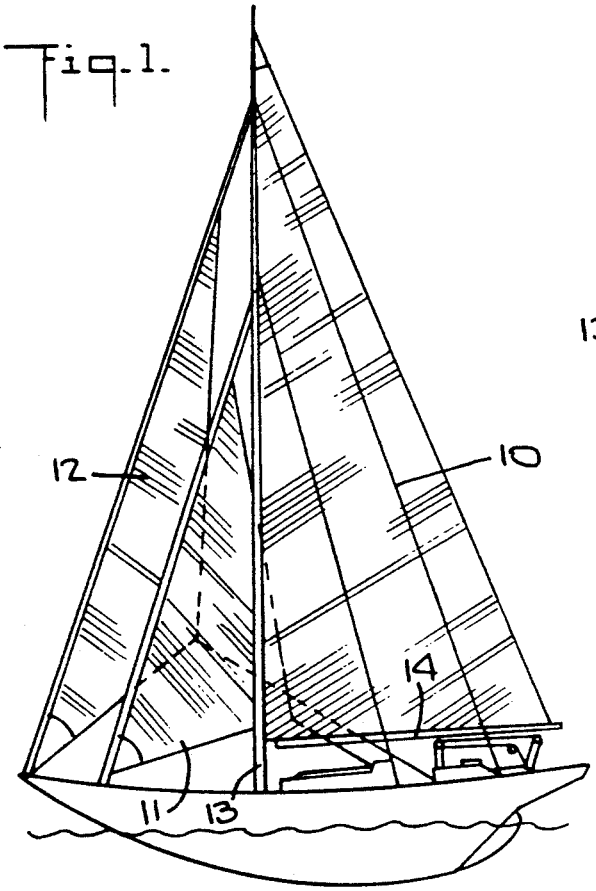
Fig. 2.
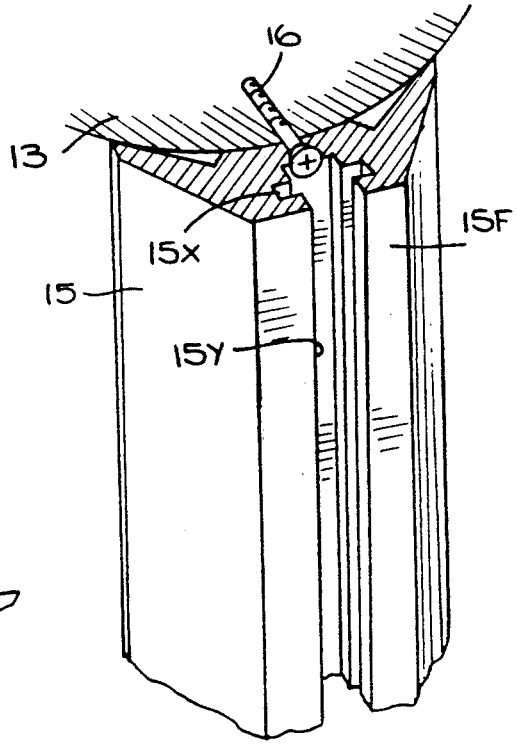
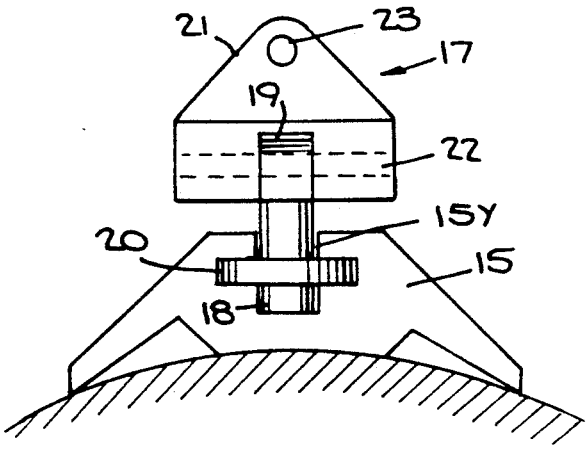
Fig. 4.
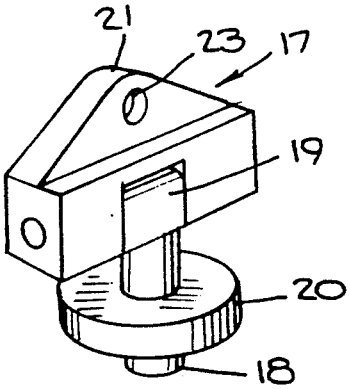
Fig. 3.

Fig. 5.
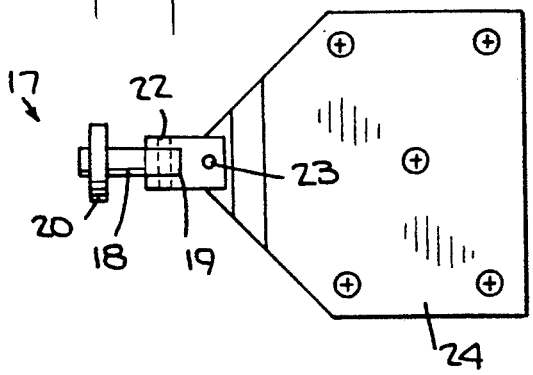
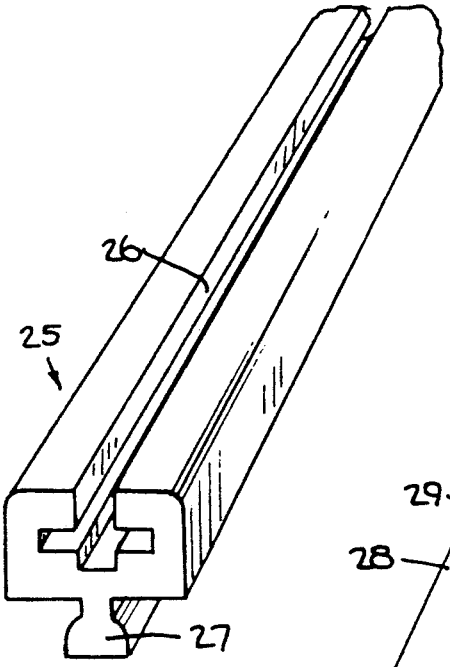
Fig. 6.
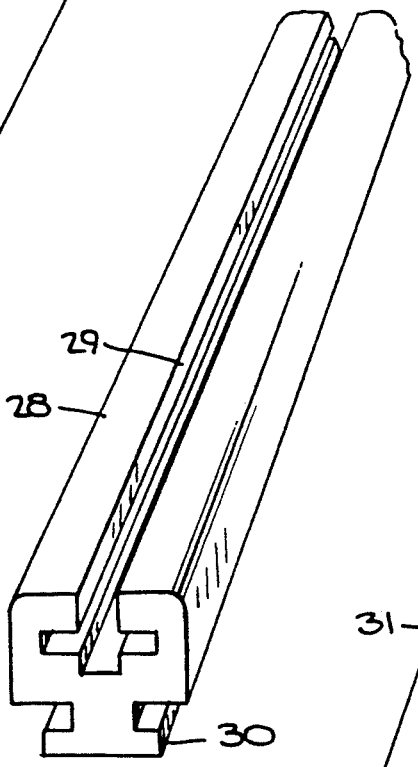
Fig. 7.
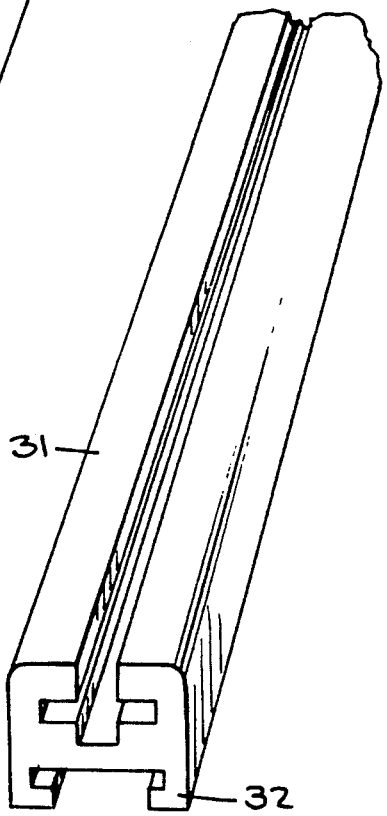
Fig. 8.

TRACK AND SLIDE ASSEMBLY FOR SAILBOATS

BACKGROUND OF THE INVENTION

1. Field of Invention

This invention relates generally to a track and slide assembly for a sailboat, the track being attached to the mast of the boat and the slides which ride along the track being coupled to the luff of a sail whose base is hitched to a boom, whereby the sail may be raised on the mast or lowered, and more particularly to an assembly of the type in which the slides are rotatable on the track as well as slidable therealong, and therefore do not bind to the track when a torque is applied to the slides by the sail.

2. Status of Prior Art

In a typical modern sailboat having fore and aft sails, the sailboat is provided with a mainsail, a foresail and a jib, the mainsail being supported by a mast. The mainsail, which is triangular, is hitched at its base to a boom which can swing about the lower part of the mast in either direction in relation to the longitudinal axis of the boat.

In order to make it possible to control, reef and stow the mainsail, use is made of a track and slide assembly whose track is attached to the mast and whose slides which ride along the track are coupled at spaced positions to the vertical or luff side of the triangular sail. In this way, when the sail is raised by a halyard to its full height on the mast, the slides then ride up the track, and when the sail is lowered so that it can be furled on the boom, the slides then ride down the track. When the sail is to be reefed to reduce the area exposed to wind, as by folding a portion of its foot and securing it to the boom with reef points, the slides then ride down the track to the extent necessary to effect reefing.

A mainsail exposed to wind forces will often subject the slides coupled to the luff of the sail to torque and other forces which may impair the ability of the slides to ride along the track. And depending on the design of the track and slide assembly, these forces may act to decouple the slides from the track and render the sail ineffective.

In many conventional track and slide assemblies, the slides are rectangular in shape or in the form of rectangular cars that run along the track. Should a torque force be applied to these slides by a mainsail, the slides, which are incapable of turning with respect to the track, will then bind to the track, thereby preventing sliding movement and making it impossible to control the mainsail.

And in those designs in which the slides ride along lips projecting from opposite sides of the track, a strong pulling force exerted on the slides by the mainsail may act to compress and deflect these lips and decouple the slides from the track.

An important factor which comes into play in the effectiveness of a track and slide assembly is the ability of the slides to ride freely up and down the track so that the sail can be raised or lowered without difficulty. Such movement is resisted should the slides encounter significant friction. It is for this reason that in some instances tracks are made of TEFLON (PTFE), a synthetic plastic material having an exceptionally low coefficient of friction. But the structural strength of a TEFLON track is not great, and the track may not stand up when heavy forces are exerted thereon by the slides coupled to the sail.

Another factor that must be taken into account in considering the effectiveness of a track and slide assembly is the manner in which the slides are linked to the luff of the mainsail. If the slides are rigidly coupled to battens attached to the luff of the sail, and in response to a wind force the sail assumes an acute angle with respect to the track mounted on the mast, then if the link between the slides and the mainsail is inflexible, this action may either disrupt the link or detach the slides from the track.

Of prior art interest are the patents to Benedict, U.S. Pat. No. 3,092,064 and Rand, U.S. Pat. No. 259,209.

SUMMARY OF INVENTION

In view of the foregoing, the main object of this invention is to provide a track and slide assembly for a sailboat that makes it possible, without undue effort, to control, reef and stow the mainsail.

More particularly, an object of this assembly is to provide an assembly of the above type which is capable of withstanding heavy forces, and in which the slides which ride along the track will not become decoupled from the track or bind thereto when torque and other forces are applied to the slides by the sail.

Also an object of this invention is to provide a track which can be securely attached to a mast regardless of its geometry, and slides which can be coupled without difficulty to the sail.

A significant feature of an assembly in accordance with the invention is that each slide terminates in a head that projects above the face of the track, the head having a link hinged thereto that is coupled to the sail, so that the link swings with respect to the head as the angle of the sail to the mast changes.

Still another object of this invention is to provide in an assembly of the above type a track having a high structural strength and an exceptionally low coefficient of friction so that the slides ride freely along the track, yet the track will withstand heavy forces transmitted thereto by the slides coupled to the sail.

Briefly stated, these objects are attained in a track and slide assembly for a sailboat having a mast and a boom, the track being attached to the mast and the slides which ride along the track being each coupled to the luff of a sail. Hence, when the sail is raised on the mast, the slides ride up the track, and when lowered, the slides then ride down the track. Formed in the track along its full length is a slot which extends below the outer face of the track and has a cruciform cross section defining a major channel and a minor channel that intersects the major channel at a point below the face of the track and is at right angles to the major channel. Each slide includes a cylindrical post that is slidable in the major channel of the track and a disc-shaped runner that intersects the post and is integral therewith, the runner being slidable in the minor channel whereby the slide is rotatable within the slot as well as being slidable thereon and therefore does not bind to the track when a torque force is applied to the slide by the sail to which it is coupled.

BRIEF DESCRIPTION OF DRAWINGS

For a better understanding of the invention as well as other objects and further features thereof, reference is made to the following detailed description to be read in conjunction with the accompanying drawings, wherein:

FIG. 1 shows a typical sailboat whose mast and mainsail are provided with a track and slide assembly in accordance with the invention;

FIG. 2 shows the track of the assembly attached to the mast;

FIG. 3 is a separate perspective view of one of the slides included in the assembly;

FIG. 4 is an end view of the track and a slide thereon;

FIG. 5 shows how the slide can be attached to a batten secured to the luff side of a sail;

FIG. 6 shows, in perspective, a second embodiment of the track;

FIG. 7 illustrates a third embodiment of the track; and

FIG. 8 illustrates a fourth embodiment of the track.

DESCRIPTION OF INVENTION

Referring now to FIG. 1, there is shown a sailboat provided with a track and slide assembly in accordance with the invention. By way of example, the sailboat illustrated is a yacht with a fore and aft rig, the yacht having a mainsail 10, a foresail 11 and a jib 12. Mainsail 10, which is triangular in shape, is supported by a mast 13, the base of this sail being hitched to a boom 14 which can swing about the lower part of the mast in relation to the longitudinal axis of the boat.

In order to make it possible to control, reef, stow, and otherwise manipulate the mainsail, use is made of a track and slide assembly whose track 15, as shown in FIG. 2, is attached to mast 13, the track running up the mast from the point at which boom 14 meets the mast, to the top of the mast. The manner in which the track is attached to the mast depends on the form of the mast and the material of which it is made. In FIG. 2, track 15 is shown as having an inner face that conforms to the curvature of the mast, the track being attached to the mast by screws 16. But such attachment means are by way of example only.

Track 15 is preferably fabricated of UHMW, an ultra high molecular weight polyethylene, a synthetic plastic material of exceptionally high strength characterized by a very low coefficient of friction approaching that of TEFLON (PTFE). Hence, the track not only provides a low friction slide path for the slides riding on the track, but it is also capable of withstanding the heavy forces exerted on the track by the slides coupled to the mainsail which is subjected to heavy wind forces and seeks to pull the sail away from the mast or to push it toward the mast depending on the design of the sail.

Track 15 has a slot formed therein which runs the full length of the track and has a cruciform cross section, as shown in FIG. 2, which defines a major channel 15Y of substantially uniform width that extends into the track body at right angles to its flat outer face 15F, and a minor channel 15X that intersects the major channel at substantially its midpoint at a point below outer face 15F and is at right angles to the major channel. Thus, the minor channel 15X is parallel to the plane of face 15F of the track.

FIGS. 3 and 4 illustrate one of the several slides, generally designated by numeral 17, which ride on track 15. These slides are coupled at spaced sections to the luff or vertical side of sail 10 and thereby link the luff of the mainsail to the mast. When sail 10 is raised by a halyard to its full height on mast 17, slides 15 then ride up the mast; and when the sail is more or less lowered, the slides then ride down the mast.

Each slide 17, which is machined or otherwise formed of stainless steel or any other corrosion-resistant, high strength metal having acceptable marine properties, includes a short cylindrical post 18 whose length is slightly greater than the height of the major channel 15Y in the track and which has a diameter substantially equal to the width of the major channel. The upper end of post 18 terminates in a block-like head 19 that projects above the outer face 15F of the track.

Integral with post 18 and intersecting it at a position corresponding to the position of minor channel 15X in the track, is a disc-shaped runner 20. Runner 20, which is at right angles to the post, is slidable in minor channel 15X.

Hingedly coupled to head 19 is a stainless steel link 21 having a yoke section whose opposing arms, which embrace head 19, are joined thereto by a pivot pin 22. Link 21 is provided with a triangular lug section that is integral with the yoke section and has at its apex a hole 23 which makes it possible to tie or otherwise couple slide 17 to the mainsail.

When the luff side of the mainsail is provided, as shown in FIG. 5, with battens 24 attached to the sail, each batten, which has a triangular lug, may be directly joined to the slide by a rivet or other means passing through hole 23.

Slides 17 are not only freely slidable in low-friction track 15, but are also rotatable thereon, for the cylindrical post 18 and the disc-shaped runner 20 which fit into the track slot are free to rotate within the slot as well as to slide in the major and minor channels defined by the slot, but the slides cannot be pulled laterally out of the slot.

One significant advantage of this arrangement is that when the mainsail is subjected to wind forces which seek to pull the slides out of the track, these forces give rise to stresses within the track. But because of the cruciform configuration of the slide and the corresponding configuration of the slot in which the slide is received, these stresses are distributed throughout the track and thereby dissipated. Another important advantage is that if the forces are torque forces which seek to turn the slides, the slides do not resist this force but rotate. Hence the slides do not bind to the track.

Still another advantage is that if the forces are angular forces which seek to angle the slide with respect to the track, the link on the slide, which is coupled to the sail, will then swing in a direction that depends on the angular force, and the angular force will therefore not be transmitted to the slide within the track.

Hence, the slides accommodate themselves to whatever twist or pull or push forces are exerted thereon by the mainsail and remain freely slidable within the track at all times. Consequently, these forces do not impair a sailor's ability to lower or raise the sail, even under the most adverse sailing conditions.

Masts installed on sailboats come in various configurations, for some have an oval cross section, others have a longitudinal slot or channel, and still others are provided with a mounting to accommodate a track. A track in accordance with the invention may be made in a shape appropriate to the particular mast for which it is intended.

Thus in the embodiment of track 25 shown in FIG. 6, this track is provided with a cruciform slot 26 as in the track in FIG. 2, but the underside of the track is provided at its center with a dome-shaped projection 27 adapted to fit into a similarly shaped channel formed in the mast, thereby neatly coupling the track to the mast.

In the embodiment of track 28 shown in FIG. 7, which also has a slot 29 having a cruciform cross section; the projection 30 on the underside of the track has a reverse T formation.

And in track 31 shown in FIG. 8, on the underside of the track is a projection having a T-shaped channel 32 adapted to socket a T-shaped projection on the mast for which it is intended.

Illustrated in FIG. 1 is a sailing yacht having a triangular mainsail, the luff of which is joined to the mast of the boat by a track and slide assembly in accordance with the invention, the base of the sail being hitched to a boom swingable about the lower portion of the mast. But this is only by way of example, for the assembly is useable with all other mast-supported sails in which it is necessary to raise and lower the sail. The assembly is applicable to a square rigger in which there is a boom on top of the sail and one at the bottom of the sail, as well as, to a gaff rig and Marconi rig.

The track and slide assembly is also applicable to a sail having full-length battens in which the sail is tensioned to hold the sail away from the mast, thereby creating forces that push against the mast rather than pulling away therefrom.

A prior art arrangement, such as that disclosed in the Benedict Pat. U.S. Pat. No. 3,092,064 in which the slide element allow saddles holding luff ropes to rotate 360 degrees around the axis of connecting pins, makes it easier to flake when lowering the sail and also easier to raise from a flaked position. However, because the connecting pins ride within a vertical slot in the track, the moment the sail begins to load, the pins then proceed to rub against the vertical edge of the track. In doing so, the pins may cut, gouge or scratch the wear surfaces of the track. And when the pins are subjected to the sail load, they then transfer this load to the slide element withing the track, causing these element to cock or bind within the track structure.

In a track and slide assembly in accordance with the invention in which the track slot slideway has a cruciform cross section and the slides running therein have a matching cross section, when loads are delivered to these slides, the bearing surfaces are not sharp edges but a series of flats which engage corresponding flat surfaces in the slideway, thereby distributing the load and avoiding the cocking and binding experienced with prior track and slide assemblies.

In a track and slide assembly in accordance with the invention, the luff of the sail is coupled to a link hinged to the head of the slide post, the head being outside of the track. The slide post is therefore rotatable 360 degrees within a plane parallel to the track, whereas the link can turn 180 degrees within a hemisphere overlying the plane.

The two distinct axes of rotation permit the sail-to-slide connection to move freely from port to starboard to reduce the leverage on the slidepost and reduce the loads imposed on the slides as they ride up and down along the track slideway while the sail is loaded by wind forces. This arrangement also enhances the aerodynamic shape of the sail, for the luff rope or other sail-slide connection is allowed to shift to each side of the track, thereby facilitating the flow of air around the mast, over the track and onto the sail.

While there has been shown and described a preferred embodiment of a track and slide assembly for sailboats in accordance with the invention, it will be appreciated that many changes and modifications may be made therein without, however, departing from the essential spirit thereof.

We claim:

1. A track and slide assembly for a sailboat provided with a mast, and a sail whose luff is coupled to the slides of the assembly, whereby when the sale is raised on the mast, the slides ride up the track; and when the sail is lowered, the slides then ride down the mast; said assembly comprising:

(a) a track attachable to the mast so that its outer face is exposed, said track having formed along its full length a slideway slot having a cruciform cross section to define a major channel of substantially uniform width that extends into the track below the outer face and a minor channel that is spaced from the outer face and intersects the major channel at substantially its midpoint at right angles thereto; and (b) a set of slides riding on the track, each slide having a cylindrical post that slides within the major channel, said post having a diameter substantially equal to the width of the major channel, and a disc-shaped runner integral with the post and intersecting the post at right angles thereto at a position corresponding to that of the minor channel, so that the runner slides within the minor channel, said slide also being rotatable within the slideway slot, whereby the slide does not bind to the track when a torque force is applied to the slide by the sail.

2. An assembly as set forth in claim 1, wherein said track is formed of synthetic plastic material of high strength having a low coefficient of friction.

3. An assembly as set forth in claim 1, in which the plastic is ultra high molecular weight polyethylene.

4. An assembly as set forth in claim 1, in which the outer face of the track is flat and the underface is shaped to conform to the mast to which the track is attached.

5. An assembly as set forth in claim 1, in which the slide is made of corrosion resistant metal.

6. An assembly as set forth in claim 1, in which the post of the slide terminates in a head that projects above the face of the track.

7. An assembly as set forth in claim 6, in which the slide includes a link that is hinged to the head and is connectable to the luff of the sail.

8. An assembly as set forth in claim 7, in which the link has a yoke-shaped section whose opposing arms embrace the head and are joined thereto by a pivot pin.

9. An assembly as set forth in claim 8, in which the link has a triangular lug section integral with the yoke section and provided with a hole at its apex.

10. A track and slide assembly for a sailboat provided with a mast, a boom and a sail whose luff is coupled to the slides, whereby when the sail is raised on the mast, the slides ride up the track; and when the sail is lowered, the slides then ride down the mast; said assembly comprising:

(a) a track attachable to the mast so that its outer face is exposed, said track having formed along its full length a slideway slot having a cruciform cross section to define a major channel of substantially uniform width that extends into the track below its face and a minor channel that is spaced from the face and intersects the major channel at right angles thereto; and (b) a set of slides riding on the track, each slide having a cylindrical post having a diameter substantially equal to the width of the major channel that slides within the major channel, and a disc-shaped runner integral with the post and intersecting the post at right angles thereto at a position corresponding to that of the minor channel, so that the runner slides within the minor channel, said slide also being rotatable 360 degrees within the slideway slot, whereby the slide does not bind to the track when a torque force is applied to the slide by the sail, each slide post terminating in a head that projects above the face of the track to which is hinged a link that is connectable to the luff of the sail, the link being rotatable 180 degrees relative to the head.

11. An assembly as set forth in claim 10, in which the link is formed of stainless steel.

* * * * *